US006285740B1

(12) United States Patent
Seely et al.

(10) Patent No.: US 6,285,740 B1
(45) Date of Patent: Sep. 4, 2001

(54) DUAL ENERGY X-RAY DENSITOMETRY APPARATUS AND METHOD USING SINGLE X-RAY PULSE

(75) Inventors: John F. Seely, Fairfax, VA (US); Craig N. Boyer, Mitchellville; Glenn E. Holland, Wheaton, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/419,261

(22) Filed: Oct. 13, 1999

(51) Int. Cl.[7] ..... H05G 1/64

(52) U.S. Cl. ..... 378/98.9; 378/101; 378/102; 378/106; 250/367; 250/370.09; 250/370.11

(58) Field of Search ..... 378/98.9, 98.11, 378/101, 102, 103, 106, 122; 250/367, 370.11, 370.09

(56) References Cited

U.S. PATENT DOCUMENTS

| | | | | |
|---|---|---|---|---|
| 3,643,094 | * | 2/1972 | Courtois | 378/106 |
| 3,783,289 | * | 1/1974 | Hafner | 378/103 |
| 3,969,628 | * | 7/1976 | Roberts et al. | 378/138 |
| 4,379,977 | * | 4/1983 | Carmel et al. | 378/136 |
| 5,138,167 | * | 8/1992 | Barnes | 250/370.01 |
| 5,216,252 | * | 6/1993 | Boone et al. | 250/486.1 |
| 5,451,793 | * | 9/1995 | Boone | 250/486.1 |
| 6,064,718 | * | 5/2000 | Holland et al. | 378/122 |
| 6,166,459 | * | 12/2000 | Holland et al. | 307/109 |
| 6,205,200 | * | 3/2001 | Boyer et al. | 378/101 |

OTHER PUBLICATIONS

J.F. Seely et al., Dual–Energy Bone Densitometry Using a Single 100 ns X–Ray Pulse, 25 Med. Phys. 2027 (No. 10, Oct. 15, 1998).

* cited by examiner

*Primary Examiner*—Robert H. Kim
*Assistant Examiner*—Allen C. Ho
(74) *Attorney, Agent, or Firm*—John J. Karasek; Sally A. Ferrett

(57) ABSTRACT

A dual-energy x-ray system is provided which is useful in densitometry and other applications. A dual energy x-ray source, formed field emission x-ray tube driven by a Marx generator, produces a single x-ray pulse of a very short duration (e.g., 10 to 200 nanoseconds). The pulse provides x-ray energy of a first, high value early in the pulse and x-ray energy of a second, lower value later in the pulse so as to provide a dual energy level x-ray distribution comprising hard and soft x-rays. A detector system having dual x-ray energy discrimination properties, formed by soft and hard x-ray detectors and an inter-detector, receives the x-ray pulse and discriminates between the dual x-ray energy levels of the pulse.

15 Claims, 3 Drawing Sheets

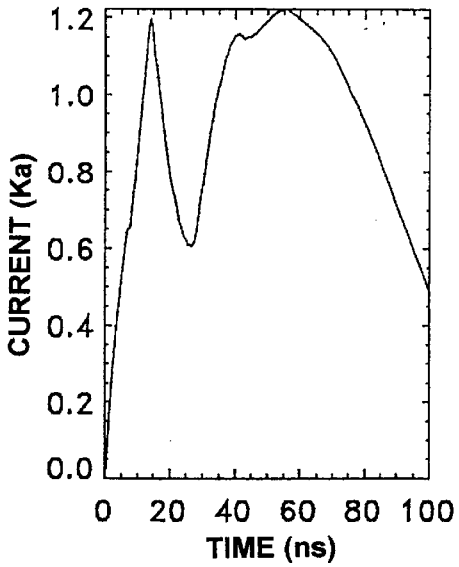
FIG. 3(a)
FIG. 3(b)
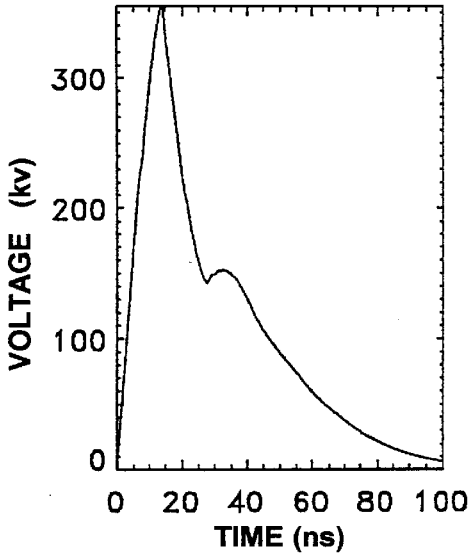
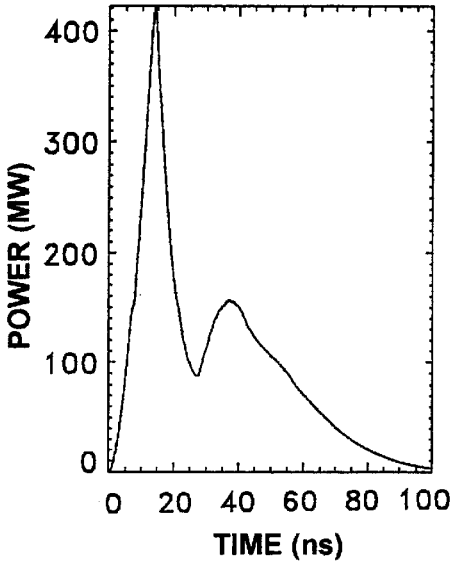
FIG. 3(c)

DUAL ENERGY X-RAY DENSITOMETRY APPARATUS AND METHOD USING SINGLE X-RAY PULSE

FIELD OF THE INVENTION

The present invention relates to x-ray systems for determining bone mineral density and for other applications, and to methods using such systems.

RELATED ART

Precision bone mineral densitometry is important for the early detection of osteoporosis and the prediction of future bone fracture risk. Bone mineral loss is associated with aging and is more rapid in post-menopausal women. In addition, bone mineral loss is accelerated during long-term bed rest and in the weightless environment of space.

Prior clinical studies indicate that the association of measured bone density with osteoporosis and bone fracture is more significant for the major weight-bearing axial sites (lumbar spine and proximal femur) than for extremity sites (hand, radius, and calcareous). The bone mineral content is correlated with the vertebral strength determine in vitro. Clinical studies also indicate that the preferred site for bone mineral densitometry may be the lumbar spine, and the preferred view is lateral rather than anterior-posterior (AP). The lateral view of the vertebrae is not obscured by the posterior vertebral elements. This permits the isolation of the trabecular bone region that is most susceptible to mineral loss. However, soft tissue absorption can affect lateral projection measurements to a greater extent than AP projection measurements.

It has been estimated that a measured bone mineral density (BMD) that is one standard deviation (approximately 2%) below the average for a control population implies a significantly higher risk of a future bone fracture. Thus, any bone densitometry technique should have at least 2% precision and absolute accuracy.

In many clinical settings, it is important to determine BMD with a short patient observation time. In addition, since BMD measurements may be repeated over a period of time, the exposure to the patient should be as low as possible for each observation. Although ultrasonic and magnetic resonance methods are convenient and have no x-ray exposure, such methods do not have the required accuracy at the present time.

The rather high precision and accuracy required for bone densitometry has resulted in the development of x-ray radiographic absorption techniques. Bone densitometry apparatus for the hand, radius, and calcareous have been developed. However, these measurements are not as significant as axial site measurements for diagnosing osteoporosis and predicting fracture risk.

Considering some of the techniques that have been used, quantitative computed tomography (QCT) x-ray scanning techniques produce three-dimensional images of skeletal regions. This permits the elimination of soft tissue attenuation and a precise determination of the BMD of interior trabecular bone regions. However, QCT techniques are not suitable for repeated clinical measurements because of the high patient dose (surface dose ~100 mrem), the long patient positioning and immobilization time (tens of minutes), and the relatively high cost of the apparatus.

Dual-energy x-ray absorptiometry (DEXA) projection scanning units have been developed by Hologic Inc. (Waltham, Mass.) and Lunar Corp. (Madison, Wis.). Using dual-energy calibration and subtraction algorithms, the attenuation by soft tissue is effectively eliminated from the measurement, and the BMD of axial sites can be precisely and accurately determined. In the case of lumbar spine and proximal femur measurements, clinical studies indicate a typical precision of 1–3% and an absolute accuracy of 4–15%. The patient surface dose is typically of order 10 mrem while the patient positioning and observation time is approximately 10 minutes.

Lumbar vertebrae have been characterized in vitro by ash mass, metrology, and bone densitometry techniques. The directly measured quantities have been compared to the equivalent quantities determined in vitro by non-invasive techniques. The measured ash mass (mineral content excluding water, soft tissue, and other combustibles) is in the range 5–15 g. The ash mass is equivalent to the bone mineral content (BMC). The volume measured by metrology is in the range 30–50 $cm^3$, and this quantity may be determined by QCT techniques. The projected area measured by metrology is in the range 11–17 $cm^2$, depending on the viewing direction, and can be determined by radiographic projection techniques. The ash mass to volume values are in the range 0.20–0.35 $g/cm^3$, and this quantity is equivalent to the bone mineral volumetric density determined by QCT. The ash mass to projected area values are in the range 0.4–1.2 $g/cm^2$. This quantity is equivalent to the bone mineral areal density that is determined by most DEXA instruments, and this quantity is usually referred to as the bone mineral density (BMD).

The primary goal for a DEXA instrument is to determine the BMD to a precision of 2%. In addition, the absolute BMD, typically in the range 0.4–1.2 $g/cm^2$, should be determined to an accuracy of 2%. The primary difficulty is to account for the soft tissue areal density, along the same line of sight, with values up to 20 to 30 $g/cm^2$ in the case of the lumbar spine.

In general, a dual-energy x-ray distribution useful in BMD measurements may be enhanced by switching the source voltage (developed by Hologic Inc.), changing the filtration (developed by Lunar Corp.), or a combination of these two techniques. Previous studies that were based on x-ray tube loading, x-ray quantum noise, and patient exposure established that x-ray energies in the two ranges 40–60 keV and 80–130 keV are suitable for dual-energy x-ray absorptiometry. Most DEXA systems are limited by x-ray quantum noise, and other noise sources (such as phosphor, detector, and electronics) are smaller. As indicated above, patient exposure is of primary concern, although the exposure provided by DEXA systems is usually lower than the exposure from other radiology procedures and from the natural background.

SUMMARY OF THE INVENTION

In accordance with the invention, a system is provided which employs a pulsed, portable hard and soft x-ray source which is useful in medical imaging in general, and BMD measurements in particular, as well as in flash x-ray absorptiometry. As discussed below, the x-ray source produces a single very short (10 to 200 nanosecond) pulse, and this is of obvious advantage in treating patients, particularly as compared with systems such as those described above which involve substantially longer patient exposure times. Further, the loading on the x-ray tube is minimal during the single x-ray pulse, thereby permitting operation of the x-ray tube at higher voltage and power levels than is possible with conventional x-ray tubes. This is important in patient diagnosis because a higher x-ray number density reaches the associated detector, thereby improving the x-ray quantum signal to noise ratio and reducing the dose absorbed by the patient.

According to one aspect of the invention, a dual-energy x-ray system is provided which comprises: a dual energy x-ray source, comprising a Marx generator and a field emission x-ray tube driven by the Marx generator, for producing a single x-ray pulse providing x-ray energy of a first value early in the pulse and x-ray energy of a second, lower value later in the pulse so as to provide a dual energy level x-ray distribution comprising hard and soft x-rays; and a detector system, having dual x-ray energy discrimination properties, for receiving said pulse and for discriminating between the dual x-ray energy levels of the pulse.

Preferably, the detector system comprises, in tandem, a soft x-ray detector, a hard x-ray detector and an inter-detector filter disposed between the soft and hard x-ray detectors for filtering soft x-rays passing through the soft x-ray detector.

A pre-filter at the x-ray tube output is preferably provided for filtering x-rays produced by the x-ray tube to enhance the dual level x-ray energy distribution, harden x-ray fluence and reduce the x-ray dosage to an object receiving the x-ray pulse.

In one preferred embodiment, the soft x-ray detector comprises a phosphor mounted on an electronic detector panel and the hard x-ray detector comprising a further phosphor mounted on a further electronic detector panel arranged in tandem with the first panel.

In an advantageous implementation, the soft x-ray detector comprises a phosphor and the hard x-ray detector comprises a scintillator.

In a second preferred embodiment employing the aforementioned implementation, the detector system comprises a first fiber optic plate, the phosphor is supported by that plate, which is, in turn, optically coupled to a second scintillating fiber optic plate to form an integral structure with the first plate. Advantageously, the phosphor and scintillator produce photons of different colors and the detector system further comprises an imaging camera for producing different colored images and CCD detectors for separately capturing the different colored images.

As indicated above the pulse produced by the x-ray source advantageously has a duration of between 10 and 200 nanoseconds. In a typical application, the pulse has a duration of about 100 nanoseconds. In a preferred implementation, the voltage of the pulse is between about 30–300 keV.

In accordance with a further aspect of the invention, a method of determining bone mineral density is provided, the method comprising: using an energy x-ray source comprising a Marx generator and a field emission x-ray tube driven by the Marx generator to produce a single x-ray pulse of a duration between 10 and 200 nanoseconds having two different x-ray energy levels during the duration of the pulse so as to provide an x-ray distribution within the pulse comprising both soft and hard x-rays, and separately detecting the two different x-ray energy levels.

Further features and advantages of the present invention will be set forth in, or apparent from, the detailed description of preferred embodiments thereof which follows.

BRIEF DESCRIPTION OF THE DRAWINGS

FIGS. 3(*a*), 3(*b*) and 3(*c*) are diagrams of the operating parameters of the x-ray tube of FIGS. 1 and 2 illustrating, respectively, the calculated current, voltage and power.

DESCRIPTION OF THE PREFERRED EMBODIMENTS

Figure 1:
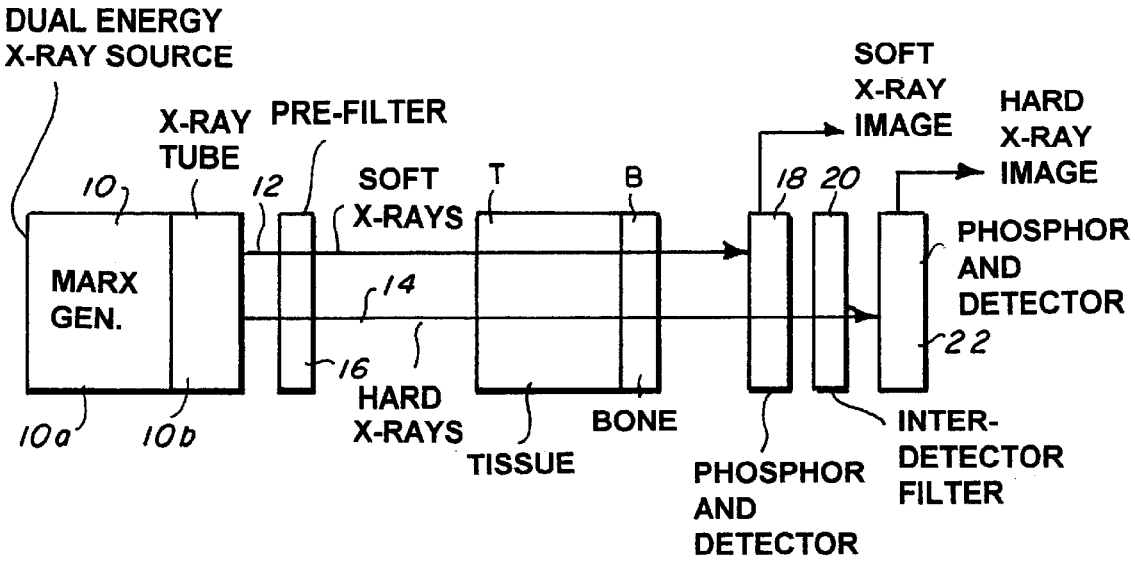
FIG. 1 is a schematic block diagram of a dual energy x-ray system incorporating a dual panel detection scheme in accordance with a first preferred embodiment of the invention.

Referring to FIG. 1, there is shown a first embodiment of the invention. The system of this embodiment referred to a dual energy x-ray source 10 which comprises a Marx generator 10*a* that drives a field emission x-ray tube 10*b* containing a tungsten anode and a mesh cathode in a vacuum. The source 10 produces a 30–300 keV x-ray pulse of 100 nanoseconds (ns) duration. In practice the duration of the pulse can be between about 10 ns and 200 ns. It will be appreciated that this duration is very much shorter than that produced by a conventional x-ray source such as is normally used for the present purposes. As indicated above and explained in more detail below the unit 10 produces both soft x-rays 12 and hard x-rays 14.

A pre-filter 16, which can comprise a 0.1 mm tantalum pre-filter, hardens the fluence, enhances the dual-energy x-ray distribution and reduces low energy x-ray fluence. Initial filtering is provided by the 0.2 thick aluminum vacuum window (not shown) of the x-ray tube 10*b* of unit 10.

The tissue and bone of a patient on which a bone mineral density (BMD) measurement is to be made are indicated, in FIG. 1, at T and B. After passing through the tissue T and bone B the soft x-rays 12 are received by a soft x-ray phosphor and detector 18, i.e. a front panel or cassette that is sensitive to the soft x-ray component, and the soft x-ray image is extracted therefrom, while the hard x-rays 14 pass through detector 18 as well as an inter-detector filter 20 to a hard x-ray phosphor and detector, i.e., a rear panel or cassette 22 that is sensitive to the hard x-ray component. The detector 18 preferably comprises a front phosphor screen that is optimized to absorb the soft x-ray component while the detector 22 preferably comprises a rear phosphor screen that absorbs the remaining hard x-ray component. The inter-detector filter 20 enhances the dual-energy discrimination by preferentially attenuating the residual soft x-rays that pass through the front phosphor screen comprising detector 18.

Discharge of Marx generator 10*a* into the field emission tube 10*b* delivers to tube a short, high power, pulse which causes explosive field emission of electrons at the tube's cathode, resulting in a plasma which produces a dual energy x-ray. Specifically, the electrostatic field across the tube's anode and cathode extracts electrons from the plasma, and accelerates them such that they impact the anode to produce characteristic and Bremstrahlung x-rays. As Marx generator 10*a* discharges, the intensity of the discharge diminishes, resulting in higher energy x-rays at the outset, and lower energy x-rays at the end of the pulse, thus producing a dual energy x-ray pulse. Because the generator's pulse is short and sharp, the x-ray pulse is of short duration but high intensity. Member 18 is selected to detect the low energy portion of the pulse, and member 22 the high energy portion, with filter 20 disposed between them to absorb whatever low-energy portion of the pulse traversed member 18. It is known that one can make Marx generators small and compact. See, U.S. patent application Ser. Nos. 09/215,499 and 09/162,150, now U.S. Pat. Nos. 6,166,459 and 6,064,718, the disclosure of each being incorporated herein by reference. By addition of a dual energy detector such as 18, 20, 22, one has a dual energy x-ray system that is small, compact, and effective for applications such as bone density scans.

Figure 2:
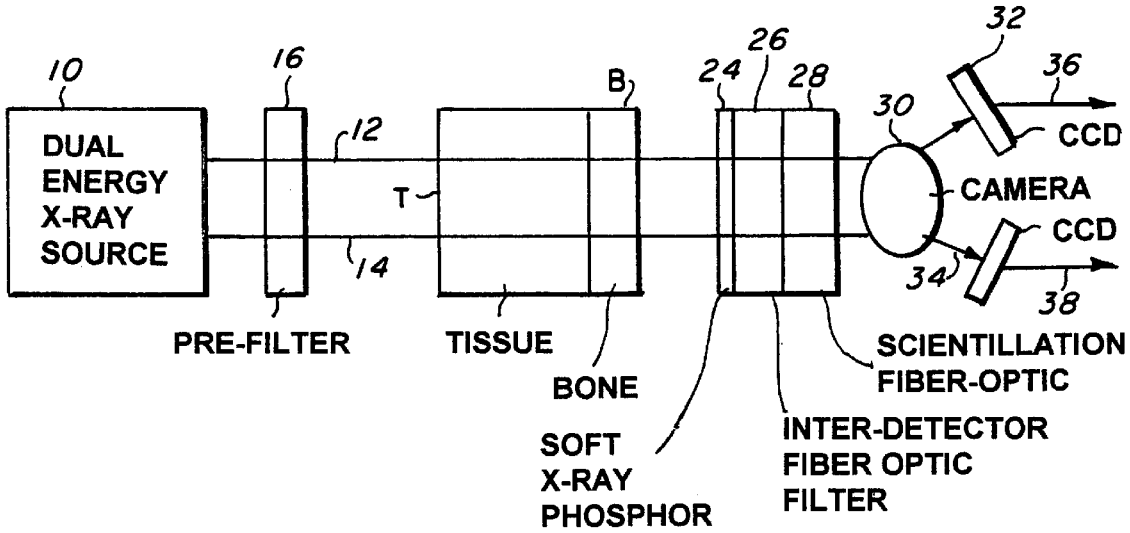
FIG. 2 is a schematic block diagram similar to FIG. 1 of a dual energy x-ray system incorporating a dual color detection scheme in accordance with a second preferred embodiment of the invention.

Referring to FIG. 2, there is shown a second, dual-color detection, embodiment of the invention. The embodiment of FIG. 2 is similar to that of FIG. 1, and like elements have been given the same reference numbers. FIG. 2 differs from FIG. 1 with respect to the detection provided. The detection arrangement of FIG. 2 includes a soft x-ray phosphor 24, an inter-detector filter fiber optic element or wafer 26 and a hard x-ray scintillation fiber optic element or wafer 28. Different colors are emitted by the phosphor 24 and scintillator 28 and a camera (prism) 30 transmits the two colors to two different CCDs 34 and 32, which produce the respective soft and hard x-ray images 38 and 36, respectively. This embodiment is particularly useful, for example, with small areas of x-ray coverage in contrast to the relative large and quite expensive detector panels 18 and 22 of FIG. 1.

Calculated values for the x-ray tube current, voltage, and power are shown in FIGS. 3(*a*), 3(*b*) and 3(*c*) respectively. The initial electron acceleration phase produced by x-ray source 10 is characterized by high tube perveance with a rapid increase in the tube current and voltage. This is followed by an arc phase in which the current continues to increase while the voltage and impedance across the tube rapidly collapse in the ensuing vacuum arc. The x-ray energy is relatively high early in the pulse (when the electron acceleration voltage is high) and decreases later in the pulse. The total charge delivered to the anode-cathode gap in the example under consideration is 0.1 mAs.

Figure 4A:
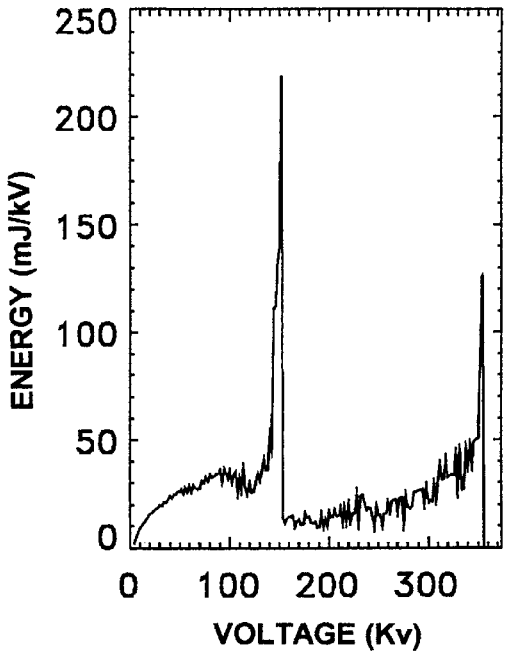
FIGS. 4(*a*) and 4(*b*) are diagrams illustrating, respectively, the energy delivered to the x-ray tube, and the x-ray tube flux.
Figure 4B:
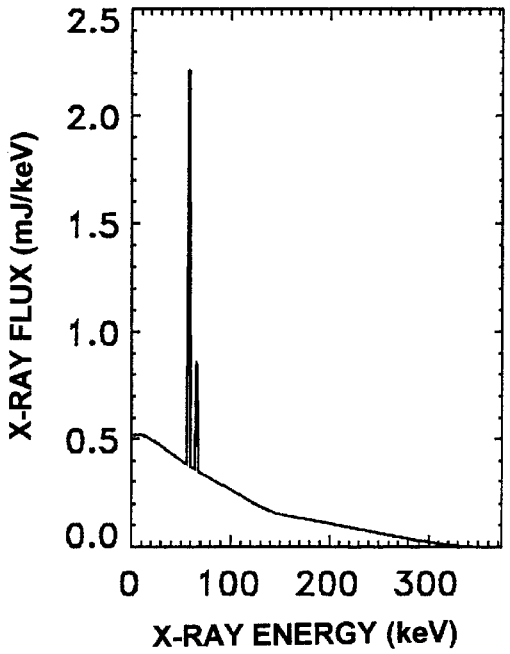

The energy delivered to the anode-cathode gap of the x-ray tube 10*b*, as a function of the electron acceleration voltage, was calculated from the time-dependent current and voltage. Based on calculated values, the energy distribution, in units of mJ per kV of anode-cathode gap voltage, is shown in FIG. 4(*a*). The energy delivered at the higher voltages (>150 kV) occurs primarily during the time of the current spike early in the current pulse when the voltage is maximal (see FIGS. 3(*a*) and 3(*b*)). The energy delivered at voltages of 30–150 kV occurs primarily during the middle of the current pulse when the current is high and the voltage is decreasing. This illustrates the dual-energy nature of the x-ray source 10, with harder x-rays emitted during the initial charge-limited electron transport across the anode-cathode gap, and softer x-rays emitted just prior to the arc phase of the discharge.

In the example under consideration, the x-ray spectrum was calculated from the current and voltage using a thick-target Bremsstrahlung model and accounting for the tungsten $K_\alpha$ and $K_\beta$ characteristic x-ray lines. The energy in the characteristic x-ray lines is 4.7 mJ, and the energy in the continuum is 63 mJ. Of the 10 J energy that is initially sorted in the energy storage capacitors, 9.8 J is delivered to the x-ray tube. The efficiency of conversion of the tube energy to x-ray energy is 0.7%.

With the present invention, in contrast to prior art DEXA systems, tube loading during a single x-ray pulse is minimal and is not a constraint on the design of the system. This permits the operation of the x-ray tube at higher voltage and power levels than is possible with more traditional x-ray tubes. The higher-energy x-rays are of diagnostic importance because a higher x-ray number density reaches the detector, thus improving the x-ray quantum signal to noise ratio and reducing the patient absorbed dose.

The x-ray detection system of the invention also has energy-discrimination capabilities. The prior art dual-energy detection systems discussed above are typically composed of a front panel or cassette that is sensitive to the soft x-ray component and a rear panel or cassette that is sensitive to the hard x-ray component. According to one aspect of the invention discussed above, energy discrimination is enhanced by positioning the inter-detector filter (20 or 26) between the two panels to attenuate the soft x-rays that pass through the front panel.

The hard x-ray images produced by the embodiments of FIGS. 1 and 2 are representative of the skeletal features, while the soft x-ray image has considerable contribution from soft tissue absorption. After the soft and hard x-ray images are captured, conventional image de-composition techniques may be used to subtract the soft tissue contribution from the hard x-ray image. In addition, the exposure in the rear panel image by x-rays scattered in the front panel may be substantially removed.

In most analyses of DEXA systems, the signals are calculated using the attenuation coefficients of the filters and the object under study and the sensitivity of the detector. Scattered radiation is usually not considered for the design of the system. In any case, scattered radiation can be characterized and accounted for as part of the in situ calibration process.

Account can be taken for the energy-dependent attenuation of the x-ray fluence by the materials that are listed in Table 1 below, for the embodiment of FIG. 2: the aluminum window of the x-ray tube 10*b*, the tantalum pre-filter 16 that hardens the x-ray fluence and enhances the dual-energy distribution, the variable tissue areal density (0–30 g/cm$^2$), the variable bone mineral areal density (0–1.5 g/cm$^2$), the phosphor screen 24 that is designed to absorb the soft x-ray component, the inter-detector filter 26, and the scintillation fiber optic 28 that absorbs the hard x-ray component. The material areal densities, volumetric densities, and thicknesses are listed in Table 1. For each material, the energy-dependent attenuation coefficient was derived from the elemental compositions listed in Table 1. The attenuation coefficient of tissue was assumed to be that of water. The bone mineral is hydroxyapatite ($Ca_5P_3O_{13}H$) with an assumed density of 0.25 g/cm$^3$ based on the lumbar vertebra metrology. The soft x-ray band, at energies less than the tantalum K absorption edge at 69.5 keV, contains the tungsten $K_\alpha$ and $K_\beta$ radiation near 58 keV and 67 keV, respectively, The hard x-ray band is maximal at 100 keV.

TABLE 1

Material compositions, densities, and thicknesses.

| Material | Elemental Composition | Density (g/cm$^3$) | Areal Density (g/cm$^2$) | Thickness (mm) |
|---|---|---|---|---|
| Aluminum x-ray tube window | Al | 2.7 | 0.0554 | 0.2 |
| Tantalum pre-filter | Ta | 16.6 | 0.17 | 0.1 |
| Tissue (water) | $H_2O$ | 1.0 | 0–30 | 0–300 |
| Bone mineral (hydroxyapatite) | $Ca_5P_3O_{13}H$ | 0.25 | 0–1.5 | |

TABLE 1-continued

Material compositions, densities, and thicknesses.

| Material | Elemental Composition | Density ($g/cm^3$) | Areal Density ($g/cm^2$) | Thickness (mm) |
|---|---|---|---|---|
| Soft x-ray phosphor | $Gd_2O_2S$:Eu | 7.5 | 0.15 | 0.2 |
| Barium glass inter-detector filter | $SiO_2$(Ba) | 3.37 | 1.7 | 5 |
| Hard x-ray scintillator | $SiO_2$($Gd_2O_2S$:Tb) | 5.0 | 7.5 | 15 |
| Soft tissue phantom (Plexiglas) | $C_5H_8O_2$ | 1.19 | 0–30 | 0–252 |
| Bone phantom (titanium dioxide) | $TiO_2$ | 4.05 | 0–1.5 | 0–3.7 |

Turning to an example, for the purpose of determining the coefficient of variation of the BMD measurements, the x-ray fluence was calculated after passing through variable densities of soft tissue (0–30 $g/cm^2$) and bone mineral (0–1.5 $g/cm^2$). The attenuation of the soft x-ray component is greater than of the hard component and the energy distribution is considerably hardened by the attenuation of the soft x-ray component by bone mineral, which is important for the sensitivity of the dual-energy technique for the precise determination of the BMD. In general, the soft x-ray energy component (40–70 keV) is designed to span the energy range where the attenuation of bone mineral (~1.0 $g/cm^2$) is rapidly decreasing with x-ray energy. The hard x-ray energy component is designed to penetrate the large soft tissue density (~20 $g/cm^2$).

In this example, based on the embodiment of FIG. 2, the phosphor 24 was chosen to be $Gd_2O_2S$ doped with Eu which fluoresces in the red region of the visible spectrum. The efficiency of conversion of x-ray energy to visible light energy is 15% (Levy Hill Laboratories Ltd, Chestnut, United Kingdom). The K absorption edge of Gd is at 50.2 keV and x-rays with energies above this value, including the tungsten K radiation near 58 keV and 67 keV, are efficiently absorbed.

The inter-detector filter 26 advantageously comprises a glass fiber optic plate with a high barium content (33% by weight; Schott Fiber Optics Inc., Southbridge, Mass.) and a thickness of, e.g., 5 mm. The barium K absorption edge is at 37.4 keV, and the tungsten K radiation is strongly attenuated, as are x-ray energies up to about 100 keV. Because of filter 26, the x-ray fluence that is absorbed by the rear scintillator 28 is primarily the hard x-ray component with energies above 100 keV.

The scintillator 28 advantageously comprises a 15 mm thick glass fiber optic plate doped with $Gd_2O_2S$:Tb (LG-9 plate; Schott Fiber Optics, Southbridge, Mass.). This material scintillates in the green region with an efficiency of 15%. The scintillator 28 absorbs essentially all of the x-ray quanta with energy below 200 keV.

In considering the x-ray fluences that are absorbed by the aluminum window of x-ray source 10, the tantalum pre-filter 16, the object (tissue T and bone mineral B), and the detector components (phosphor 24, inter-detector filter 26, and scintillator 28), of primary interest are the fluences absorbed by the front phosphor 24 and the rear scintillator 28. As indicated above, the phosphor 24 preferentially absorbs the soft x-ray component 12 and the scintillator 28 of the hard component 14 and thus provides the basis for the dual-energy de-composition of the tissue and bone mineral attenuation.

For the purpose of determining the BMD, it was assumed that the red photons from the phosphor 24 (the soft x-ray image) and the green photons from the scintillator 28 (the hard x-ray image) are collected and separately detected as provided in FIG. 2 using the imaging cameras 30 with associated CCD detectors 32 and 34 which separately capture the red and green images (XC-003 RGB 3CCD camera, Sony Corp.). The computer model used accounts for the transmission of red photons through the phosphor 24 and the channeling of the red photons through the barium glass of the filter 26 and the scintillation fiber optic plates of scintillator-detector 28 to the imaging system and camera 30. The green photons are channeled through the scintillation fiber optic plate of detector 28 to the imaging system and camera 30. It was assumed that the collection efficiency of the imaging system is 10% and that the detection efficiency of the camera system is 1%.

It can be shown that the number of visible light photons that are generated and detected is much greater than the number of x-ray quanta that are absorbed. Thus x-ray quantum noise is the dominant contributor to the coefficient of variation of the BMD.

Before considering the BMD determination process further, it will be understood that the BMD determining method described here, i.e., of separately detecting the optical photons generated by the soft and hard x-ray components can also use the embodiment of FIG. 1 wherein the two tandem electronic detection panels 18 and 22 are in contact with the phosphor and the scintillator. In an advantageous implementation of this embodiment, the electronic detection panels 18 and 20 are of the amorphous silicon type, and an active matrix of silicon pixels, each with a field effect transistor (FET), is fabricated on a thin glass substrate. The panels are not susceptible to radiation damage. As described above, in this dual energy x-ray detection scheme, the soft x-ray image is captured by the front phosphor/panel 18, and the hard x-rays are transmitted to the rear phosphor/panel 22 while the inter-detector filter 20 attenuates any soft x-rays that may pass through the front phosphor/panel 18. Since the optical photons generated by the soft x-ray phosphor are captured by the front panel 18 and are not channeled to another location for detection, it is not necessary that the inter-detector filter 20 and the hard x-ray detector panel 22 be fiber optic plates. In addition, it is not necessary that the soft and hard x-ray conversion screens be of the same type nor that these screens generate optical photons of different colors as in the embodiment of FIG. 2.

For definiteness in the following description, it will be assumed the red phosphor and green scintillator dual-energy x-ray detection scheme of FIG. 2. However, as indicated above, it is believed, from modeling, that the signals from the amorphous silicon panels would be comparable to those calculated for the red phosphor and green scintillator scheme.

The coefficient of variation (CV) of the measurement of the BMD is calculated using the usual expressions:

$$CV = (1/N_{pixels}^{1/2})(\sigma(t_B)/t_B)$$

$$\sigma^2(t_B) = \left(\sigma^2(N_P)(\partial N_S/\partial t_T)_{t_B}^2 + \sigma^2(N_S)(\partial N_P/\partial t_T)_{t_g}^2\right)J^{-2}$$

$$J = (\partial N_P/\partial t_T)_{t_B}(\partial N_S/\partial t_B)_{t_Y} - (\partial N_S/\partial t_T)_{t_B}(\partial N_P/\partial t_B)_{t_T}$$

where $t_B$ and $t_T$ are the bone mineral and tissue areal densities, $\sigma(t_B)$ is the variance in the BMD measurement, $N_{pixels}$ is the number of detector pixels in the region of interest, and $N_P$ and $N_S$ are the numbers of x-ray quanta absorbed per pixel in the phosphor and scintillator, respectively. The partial derivatives of $N_P$ and $N_S$ are taken at constant bone mineral or tissue densities. J is the Jacobian of the transformation from the densities ($t_B$ and $t_T$) as a function of absorbed quanta ($N_P$ and $N_S$) to the absorbed quanta as a function of densities. The latter quantities, the absorbed quanta as a function of the densities, are more convenient to calculate. It is assumed that $\sigma^2(N_P)=N_P$ and $\sigma^2(N_S)=N_S$.

The numbers of x-ray quanta (summed over energy) absorbed per pixel in the phosphor and the scintillator ($N_P$ and $N_S$, respectively are approximately 600–900 for small BMD and decrease to 400–700 for 1.5 g/cm$^2$ BMD. The numbers of detected photons per pixel (red from the phosphor 24 and green from the scintillator 28) are much larger.

The CV is quite sensitive to the partial derivatives of the numbers of absorbed x-ray quanta per pixel that appear in the Jacobian. The slopes of the absorbed quanta curves as functions of bone mineral and tissue density have large negative values for small densities, and this results in low CV values for small BMD.

The value of the BMD can be inferred from the number of detected red and green photons from the phosphor and the scintillator and by using the average attenuation coefficients of tissue and bone mineral. Let $\tau_P$ and $\tau_S$ be the energy-averaged attenuation coefficients of tissue weighted by the number of x-ray quanta absorbed by the phosphor 24 and the scintillator 28, respectively. Let $\beta_P$ and $\beta_S$ be the energy-averaged attenuation coefficients of bone mineral weighted by the number of x-ray quanta absorbed by the phosphor and the scintillator, respectively. After passing through a tissue density of $t_T$ and a BMD of $t_B$, the x-rays that are absorbed by the phosphor and the scintillator result in red and green photon fluences of $$R=R_O e^{-\tau_P t_T-\beta_P t_B} \text{ and } G_O e^{-\tau_S t_T-\beta_S t_B}$$

where $R_O$ and $G_O$ are the red and green fluences in the absence of the bone and tissue materials. The tissue density $t_T$ can be eliminated, and the two equations can be solved for the BMD, $$t_B=(\rho ln(G_O/G)-ln(R_O/R))/\delta$$

where $\rho=\tau_P/\tau_S$ and $\delta=\rho\beta_S-\beta_P$. In effect, the soft tissue contribution has been removed from the hard x-ray signal.

The inferred BMD is inaccurate at larger values of BMD, and this indicates the need for a calibration phantom as discussed below.

Contour plots of the number of x-rays absorbed by the phosphor 24 and the scintillator 28, in units of $10^3$ quanta per pixel, plotted as functions of the tissue and bone mineral densities in units of g/cm$^2$, indicate that the x-ray quantum noise is higher than the visible photon noise throughout the range of tissue and bone densities.

For a 20 mm region of interest, the CV values that have been plotted are less than 2% for the range of BMD that is typically encountered in lumbar spine and proximal femur densitometry.

In order to improve the accuracy of the inferred BMD, a calibration phantom was implemented in the computer model. Traditional calibration phantoms are commonly composed of Plexiglas to simulate soft tissue and aluminum to simulate bone mineral. As listed inn Table 1, Plexiglas has composition of $C_5H_8O_2$ and a density 1.19 g/cm$^3$. The x-ray attenuation of Plexiglas is similar to that of soft tissue.

The atomic number (13) of aluminum is similar to the weight-averaged atomic number (14.1) of hydroxyapatite ($Ca_5P_3O_{13}H$), the major constituent of bone mineral. However, the attenuation coefficients of aluminum and hydroxyapatite significantly differ at the soft and hard x-ray energies typically used for dual-energy bone densitometry. A search of readily available materials revealed that $TiO_2$ is better calibration phantom for hydroxyapatite than is aluminum. For an appropriate thickness of $TiO_2$, the attenuation coefficients at the soft and hard x-ray energies are in good agreement with those of hydroxyapatite.

The attenuation coefficients of tissue and bone mineral were replaced by those of Plexiglas and $TiO_2$ in the computer model used above and the same procedure was used to calculate the x-rays absorbed in the phosphor 24 and scintillator 28 and the resulting red and green photons. The calibration quantities $\rho$ and $\delta$ were derived for the calibration phantom.

The ratio of the $\rho$ values for the tissue/bone case and the Plexiglas/$TiO_2$ case and the corresponding ratio of the $\delta$ values were used to correct the $\rho$ and $\delta$ values that were used to calculate the BMD. This was done by fitting a smooth surface, that was a polynominal function of the tissue and bone mineral densities, to the surfaces. The errors in the inferred BMD were less than 2% for the quadratic and cubic fits except for very small values of bone mineral and tissue densities. Thus a reasonably low-order polynominal correction can be made to the inferred bone density by using the Plexiglas/$TiO_2$ calibration phantom.

Although the invention has been described above in relation to preferred embodiments thereof, it will be understood by those skilled in the art that variations and modifications can be effected in these preferred embodiments without departing from the scope and spirit of the invention.

What is claimed is:

1. A dual-energy x-ray system comprising:

a dual energy x-ray source, comprising a field emission x-ray tube driven by a Marx generator, for producing a single x-ray pulse providing x-ray energy of a first value early in the pulse and x-ray energy of a second, lower value later in the pulse so as to provide a dual energy level x-ray distribution comprising hard and soft x-rays; and a detector system, having dual x-ray energy discrimination properties, for receiving said pulse and for discriminating between the dual x-ray energy levels of said pulse.

2. A dual-energy x-ray system as claimed in claim 1 wherein said detector system comprises, in tandem, a soft x-ray detector, a hard x-ray detector and an inter-detector filter disposed between said soft and hard x-ray detectors for filtering soft x-rays passing through said soft x-ray detector.

3. A dual-energy x-ray system as claimed in claim 2 further comprising a pre-filter at the output of the x-ray tube for filtering x-rays produced by said x-ray tube to enhance the dual level x-ray energy distribution, harden x-ray fluence and reduce x-ray dosage to an object receiving said x-ray pulse.

4. A dual-energy x-ray system as claimed in claim 2 wherein said soft x-ray detector comprises a phosphor mounted on an electronic detector panel and said hard x-ray detector comprising further phosphor mounted on a further electronic detector panel arranged in tandem with said first panel.

5. A dual-energy x-ray system as claimed in claim 2 wherein said soft x-ray detector comprises a phosphor and said hard x-ray detector comprises a scintillator.

6. A dual-energy x-ray system as claimed in claim 5 wherein said detector system comprises a first fiber optic plate, wherein said phosphor is supported by said plate, and wherein said scintillator comprises a scintillator element supported by a further fiber optic plate and forming an integral structure with said first plate.

7. A dual-energy x-ray system as claimed in claim 5 wherein said phosphor and said scintillator produce photons of different colors and said detector system further comprises an imaging camera for producing different colored images and CCD detectors for separately capturing said different colored images.

8. A dual-energy x-ray system as claimed in claim 1 wherein said pulse produced by said x-ray source has a duration of between 10 and 200 nanoseconds.

9. A dual-energy x-ray system as claimed in claim 8 wherein said pulse has a duration of about 100 nanoseconds.

10. A dual-energy x-ray system as claimed in claim 8 wherein said pulse has a voltage of 30–300 keV.

11. A method of determining bone mineral density, said method comprising:

using an energy x-ray source comprising a Marx generator and a field emission x-ray tube driven by the Marx generator to produce a single x-ray pulse of a duration between 10 and 200 nanoseconds having two different x-ray energy levels during the duration of the pulse so as to provide an x-ray distribution within the pulse comprising both soft and hard x-rays, and separately detecting the two different x-ray energy levels.

12. A method as claimed in claim 11 wherein the two different x-ray energy levels are detected using a detector system comprising a soft x-ray detector and a hard x-ray detector and wherein an inter-detector filter is disposed between said soft and hard x-ray detectors for filtering soft x-rays passing through said soft x-ray detector.

13. A method as claimed in claim 12 further comprising providing a pre-filter for filtering x-rays produced by said x-ray tube to enhance the dual level x-ray energy distribution, harden x-ray fluence and reduce x-ray dosage to an object receiving said x-ray pulse.

14. A method as claimed in claim 12 wherein the soft x-ray detector used comprises a phosphor and the hard x-ray detector used comprises a scintillator, wherein said phosphor and said scintillator produce photons of different colors, wherein different colored images are produced using an imaging camera and wherein colored images are separately captured using the different CCD detectors.

15. A method as claimed in claim 11 wherein the pulse produced has a voltage of 30–300 keV.

* * * * *